United States Patent [19]

Garcia

[11] Patent Number: 4,805,766

[45] Date of Patent: Feb. 21, 1989

[54] DISPLAY PACKAGE FOR A COSMETIC ARTICLE

[75] Inventor: Frank Garcia, Brooklyn, N.Y.

[73] Assignee: Arthur Matney Co., Inc., Brooklyn, N.Y.

[21] Appl. No.: 167,410

[22] Filed: Mar. 14, 1988

[51] Int. Cl.[4] ..... B65D 73/00

[52] U.S. Cl. ..... 206/45.34; 206/581; 206/461; 206/471; 206/807

[58] Field of Search ..... 206/45.31, 45.34, 581, 206/471, 461, 807; 53/427

[56] References Cited

U.S. PATENT DOCUMENTS

| | | | |
|---|---|---|---|
| 3,139,182 | 6/1964 | Edell | 206/471 |
| 3,211,503 | 10/1965 | Barnes | 206/45.34 |
| 4,469,226 | 9/1984 | Matney | 206/461 X |

*Primary Examiner*—William Price
*Attorney, Agent, or Firm*—Hoffmann & Baron

[57] ABSTRACT

A display package for a cosmetic case having a base containing a cosmetic product and a cover pivotally joined to the base includes a support backing, and first and second pre-formed blisters mounted on the backing. The first blister has a main blister portion which is raised from the backing, and an edge flange joined to the main blister portion and secured to the backing. The main blister portion has an open side and defines a pocket for receiving the base of the cosmetic case. The second pre-formed blister has a main blister portion which is raised from the backing an an edge flange joined to the main blister portion and secured to the backing. The second pre-formed blister is situated on the backing adjacent to the open side of the first pre-formed blister such that the second pre-formed blister forms an obstruction to the removal of the cosmetic case from the first pre-formed blister through its open side.

12 Claims, 3 Drawing Sheets

Fig. 6
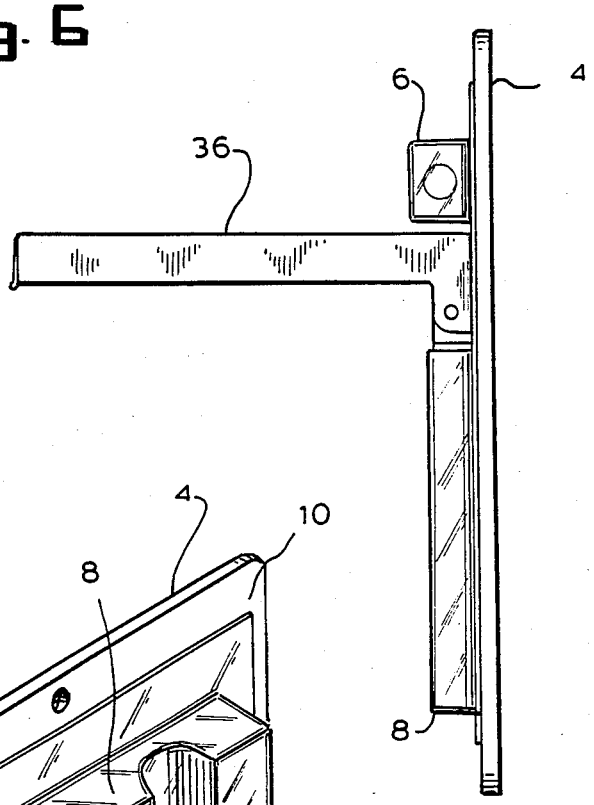
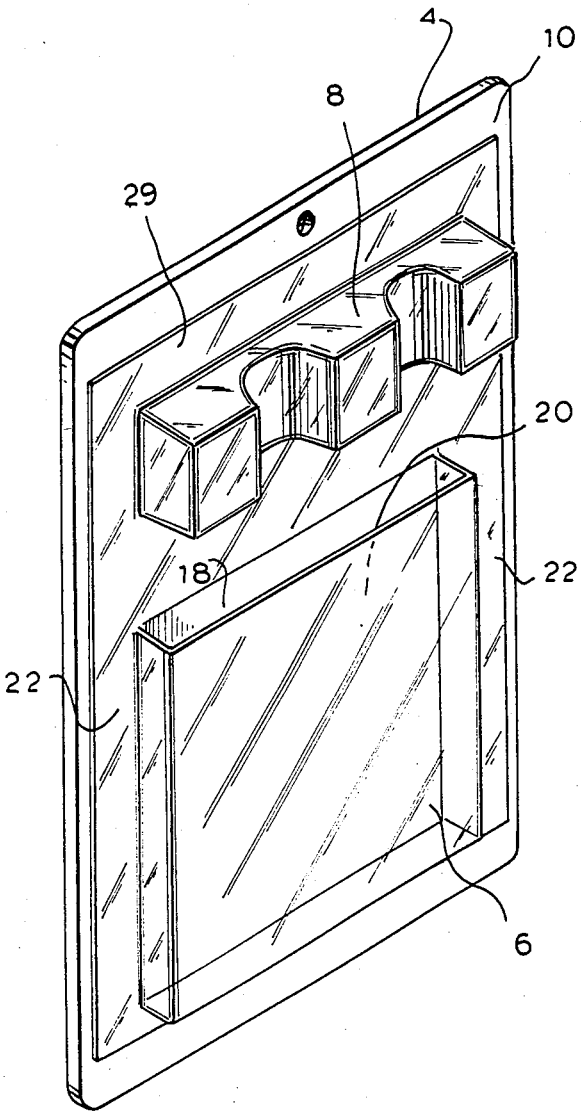
Fig. 7

DISPLAY PACKAGE FOR A COSMETIC ARTICLE

BACKGROUND OF THE INVENTION

1. Field of the Invention

This invention relates generally to display packages and more particularly to a display package for a cosmetic product, which package is tamper resistant yet allows the consumer to view the cosmetic contents of the article prior to purchasing the article.

2. Description of the Prior Art

Display packages for use with cosmetic articles which allow a purchaser to view the contents of the article without removing the article from the package are well known in the art. Such packages are often used with compact cases containing face powders, which cases may be opened and closed by the consumer, prior to purchasing the article, while the compact case remains secured to the package so that the consumer may check the shade of the face powder. Such display packages also resist tampering by the consumer.

For example, in U.S. Pat. No. 4,469,226 which issued to Arthur Matney, a display package is disclosed for use with a cosmetic compact case. The display package includes a transparent pre-formed blister which is heat-sealed to a support backing. The blister covers the base of the compact case, which base contains the face powder, and the cover of the case closes over the blister.

The structure mentioned above of the display package disclosed in the Matney '226 patent provides a number of apparent advantages. First, because only the base of the compact case is secured in the package, the cover is accessible to the consumer who may open the compact case without removing it from the package.

Second, the actual face powder, contented of the compact case are viewable so that the consumer may check to see if the powder's shade is compatible.

Third, the face powder remains protected by the blister, even when the compact case is opened.

Fourth, the display package disclosed in the Matney '226 patent remains secured to the package even though the contents of the compact case are viewable to the consumer prior to purchasing the product. Thus, there is no need to remove the compact case from the package to view its contents so that the integrity of the display package remains intact.

The display package of the Matney '226 patent is particularly useful for compact cases having an overall circular or oval configuration. An opening 58 is provided in the blister (see FIG. 2 of the Matney '226 patent) to accommodate the compact case hinge, and the blister conforms in shape to the round base of the compact case and covers a substantial portion of the base. In this way, the compact case may not be removed from the display package, but may easily be opened to see its contents.

OBJECTS AND SUMMARY OF THE INVENTION

It is an object of the present invention to provide a display package for a cosmetic article which allows a purchaser to examine the contents of the article without removing the article from the package.

It is another object of the present invention to provide a display package for a cosmetic article, and in particular, a cosmetic case having a base containing a cosmetic product and a cover pivotally mounted on the base so that the case may be opened and closed, which package allows the case to be opened and closed without damage to the display package.

It is a further object of the present invention to provide a tamper resistant display package for displaying an article as well as the contents of the article.

It is yet another object of the present invention to provide a display package for an openable cosmetic case which secures the case to the package but allows the case to be opened to view its contents.

It is yet another object of the present invention to provide a combination display package and cosmetic case in which the two cooperate so that the cosmetic case does not shift within the display package when in a closed position and will not slip out of the display package when the case is in an open position.

It is yet a further object of the present invention to provide a method for assembling a display package and mounting a cosmetic case in the display package.

The present invention is an alternative design to that disclosed in Matney U.S. Pat. No. 4,469,226. It is particularly adapted for displaying a cosmetic article having a rectangular case with a hinged cover and base, but the principles behind its design are equally applicable to openable cases of rounded shape. The display package allows the cosmetic case to be opened so that the contents of the case are viewable, while the case remains secured to the package.

In accordance with one form of the present invention, the display package includes a support backing having a display surface, and first and second pre-formed blisters mounted on the display surface of the support backing.

The first pre-formed blister has a main blister portion which is raised from the display surface, and further has an edge flange joined to the main blister portion. The edge flange is secured to the display surface by heat sealing or other methods. The main blister portion of the first pre-formed blister includes an open side, and defines a pocket for receiving a cosmetic article in the pocket and for securing the article to the support backing.

The second pre-formed blister also includes a main blister portion which is raised from the display surface of the support backing, as well as an edge flange which is joined to the main blister portion of the second blister. The edge flange is secured to the display surface.

The second pre-formed blister is situated on the display surface adjacent to the open side of the first pre-formed blister such that the second pre-formed blister forms an obstruction to the removal of the cosmetic article from the pocket of the first pre-formed blister through the open side of the blister.

Preferred forms of the display package, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 6 is a side view of the display package and case shown in FIG. 5, with the cover of the case in an open position.

FIG. 7 is a display package constructed in accordance with another form of the present invention.

DETAILED DESCRIPTION OF THE PREFERRED EMBODIMENTS

Figure 1:
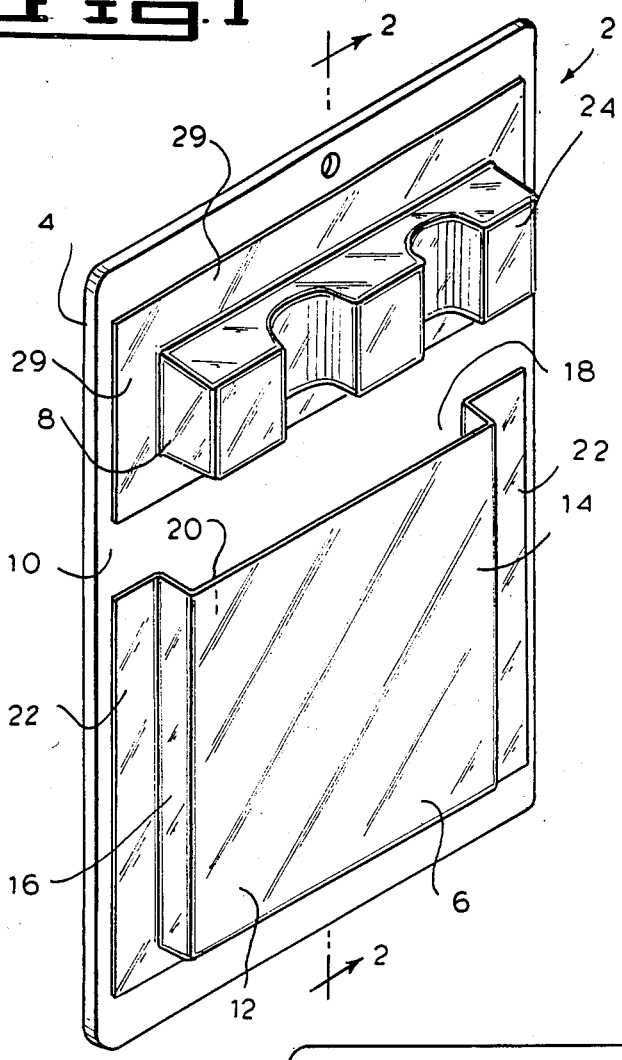
FIG. 1 is a perspective view of a display package constructed in accordance with one form of the present invention.
Figure 2:
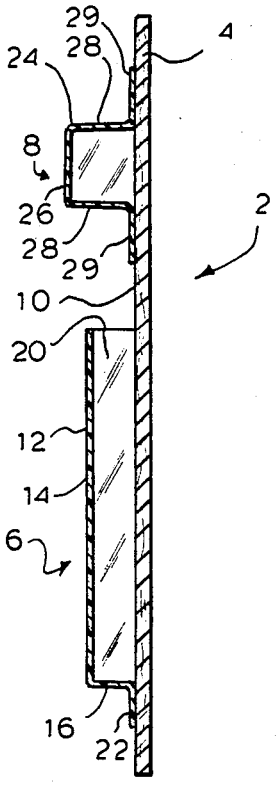
FIG. 2 is a sectional view of the display package of FIG. 1 taken along line 2-2 of FIG. 1.

FIGS. 1 and 2 of the drawings show a display package 2 constructed in accordance with the present invention. As is evident from FIGS. 1 and 2, the display package 2 shown is particularly adapted for use with a cosmetic article having an overall rectangular or square shape. However, the principles underlying the invention's construction are equally applicable for use with a cosmetic article of oval or round design.

There are three basic elements of the display package of the present invention—a support backing 4, a first pre-formed blister 6, and a second pre-formed blister 8.

The support backing 4 is preferably a relatively rigid sheet of cardboard or similar cellulosic stock material. The backing 4 may be sufficiently thick so that it is substantially stiff to resist bending. Cardboard of about 10-20 mil. thickness is quite suitable for use. The support backing 4 is dimensioned so that it fully supports the cosmetic article to be attached to the display package and, as will be seen, is large enough so that the first and second pre-formed blisters 6, 8 may be securely mounted on it.

The first pre-formed blister 6 is mounted on one surface (referred to hereinafter as the display surface 10) of the support backing 4. The first pre-formed blister 6 includes a main blister portion 12 having a rectangular top wall 14 and three side walls 16 that are perpendicular to the display surface 10 of the support backing and joined to three sides of the top wall 14. The main blister portion 12 has a fourth side 18 which is open. Thus, the main blister portion 12 is raised from the display surface 10 of the backing a distance sufficient to accommodate the cosmetic article, or a part of the article, and defines a pocket 20 for receiving the cosmetic article and securing it to the display package 2.

The first pre-formed blister 6 also includes an edge flange 22 which is joined to the main blister portion 12. More specifically, the edge flange 22 is connected to the three side walls 16 of the main blister portion and thus surrounds the main blister portion on three of its sides.

The edge flange 22 is provided for securing the blister to the display surface 10 of the support backing. Conventional techniques may be used for securing the edge flange to the backing, such as heat sealing, or using an adhesive.

The second pre-formed blister 8 is also mounted on the display surface 10 of the support backing 4. Like the first blister, the second blister 8 includes a main blister portion 24 formed with a top wall 26 and four side walls 28 extending perpendicularly to the display surface 10 of the backing and joined to the top wall 26. An edge flange 29 is joined to and surrounds the main blister portion of the second blister, and is secured to the display surface 10 by heat sealing or by using an adhesive. Thus, the main blister portion 24 of the second blister 8 is also raised from the display surface 10, and may define a chamber or enclosure 28 which houses a second cosmetic article. For purposes which will be described, the height of the main blister portion 24 of the second blister is preferably at least about equal to the height of the main blister portion 12 of the first blister.

The second pre-formed blister 8 is situated on the support backing 4 adjacent to the open side 18 of the first pre-formed blister 6. Positioned thusly, it acts as an obstruction to the removal of the cosmetic article from the first blister 6 through the open side 18 of the first blister.

FIGS. 3 through 6 illustrate how the present invention acts to keep a cosmetic article secured to the package while allowing a purchaser to examine the contents of the article, without the purchaser having to remove the article from the package.

The display package 2 of the present invention is designed primarily for use with a cosmetic article in the form of a case 30, having a base 32 containing the cosmetic product 34, and a cover 36 that is pivotally joined to the base 32 at a hinge 38. A typical case 30 of this nature may contain a face powder, eye shadow or similar cosmetic product 34. The case 30 may be opened by pivoting the cover 36 away from the base 32 to expose the cosmetic contents 34 of the base, and closed in the same manner. Usually such cases include a latching mechanism, such as a resilient extension 40 of the cover and a cooperating protuberance 42 on the base, to retain the case in the closed position until sufficient force is applied to open it.

The cosmetic case 30 with which the embodiment of the display package shown in FIGS. 3 through 6 is particularly designed to cooperate is rectangular or square in overall shape, although the invention is envisioned to be used with openable cases of other shapes. One problem which is particularly inherent with packaging square cosmetic cases, which problem is overcome by the present invention's design, is how to secure the cosmetic case 30 to the support backing 4, allowing the cover 36 of the case to open and close without the blister interfering the operation of the case's hinge 38. In the Matney '226 patent, the preferred form of the disclosed display package secured a round compact case to the back panel of the package. The hinge of the case did not extend across the full diameter of the case. Consequently, the pre-formed blister could be shaped so that it almost fully encircled the base of the compact case except for an opening provided in the blister for the hinge, which opening is made smaller than the diameter of the case. Thus, the case was held captive within the blister.

With the cosmetic case envisioned to be used with the preferred form of the display package of the present invention, the hinge 38 extends entirely across the full width of the case 30, and care must be taken to insure that the blister of the package does not interfere with the hinge 38 and prevent the cover 36 from opening.

As shown in FIGS. 3 through 6, the case 30 is retained in the main blister portion 12 of the first pre-formed blister 6, with the top wall 14 of the blister covering most, if not all, of the cosmetic product 34 contained in the base 32. This, of course, protects the cosmetic product from being touched or used prior to purchase. The height of the side walls 16 of the first pre-formed blister, or stated another way, the height that the main blister portion 12 is raised from the display surface 10 of the backing, is at least equal to the height of the base 32 of cosmetic case 30 so that the case closely fits in the pocket 20 defined by the first blister 6.

The display package 2 is designed so that the hinge portion 38 of the cosmetic case extends from the pocket 20 defined by blister through the blister's open side 18. This allows the cover 36 of the case to pivot freely on the base 32 without the blister 6 interfering with the case hinge 38. The cover 36 may be opened, so that the contents of the cosmetic case 30 may be viewed through the blister 6, and closed such that the top wall 14 is sandwiched between the base 32 and the cover 36. Because of the relative thinness of the blister 6, the latching mechanism of the case is still operational with the case contained in the blister pocket 20, as the resilient extension 40 of the cover still properly engages the protuberance 42 on the base even with the blister 6 interposed between them. When the case 30 is closed and latched, it will not slide in the blister pocket 20, thus further securing the case in the blister 6.

The second pre-formed blister 8 helps prevent the case 30 from being removed from the first blister 6 through the open side 18 of the pocket when the case is unlatched and opened. As mentioned previously, the second blister is positioned on the support backing 4 adjacent to the open side 18 of the first blister 6. The height of the second blister 8 is preferably at least the height of the first blister 6 so that the second blister 8 acts as an obstruction to prevent the cosmetic case, when unlatched, from inadvertently sliding out of the pocket 20 through open side 18 or if the cosmetic case 30 were attempted to be removed from the first blister 6 through its open side 18. This feature provides the display package of the present invention with a measure of tamper resistance, to deter a purchaser from removing the cosmetic article from the package prior to purchasing the article. Of course, it is possible for the purchaser to bend the support backing 4 and remove the case; however, the backing is made sufficiently stiff to deter this.

Figure 4:
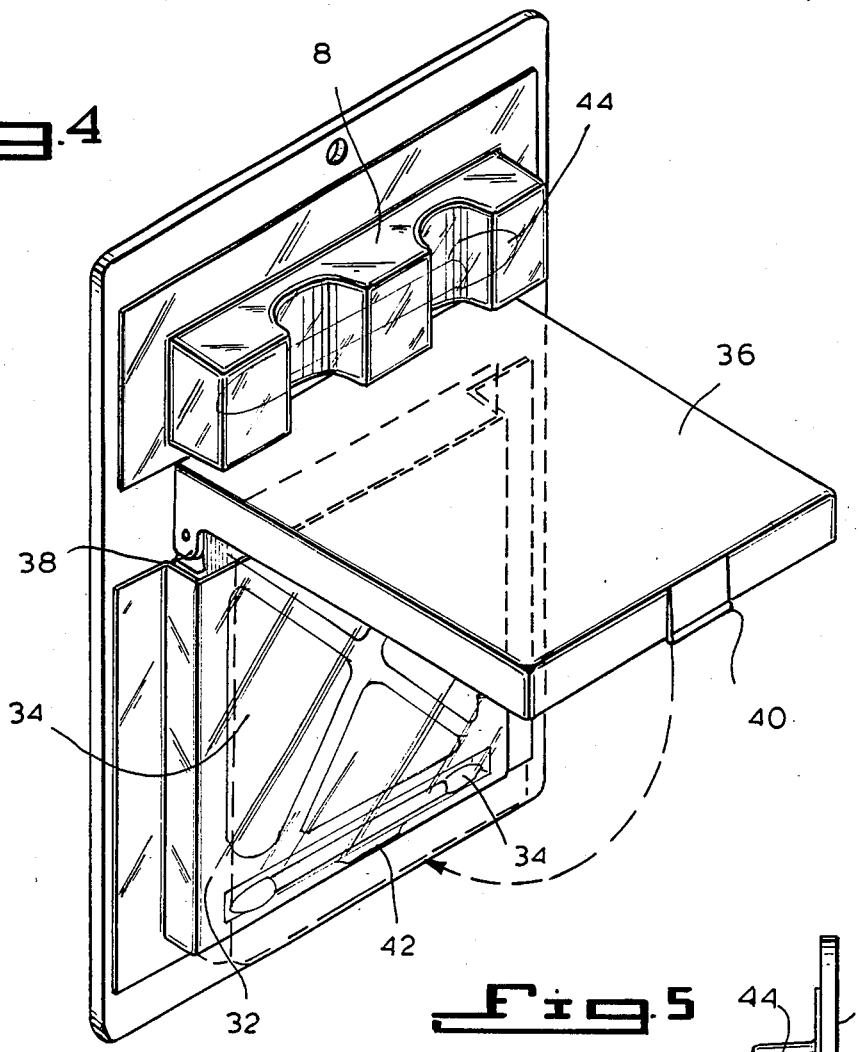
FIG. 4 is a perspective view of the display package and cosmetic case shown in FIG. 3, with the cover of the case in an open position.
Figure 5:
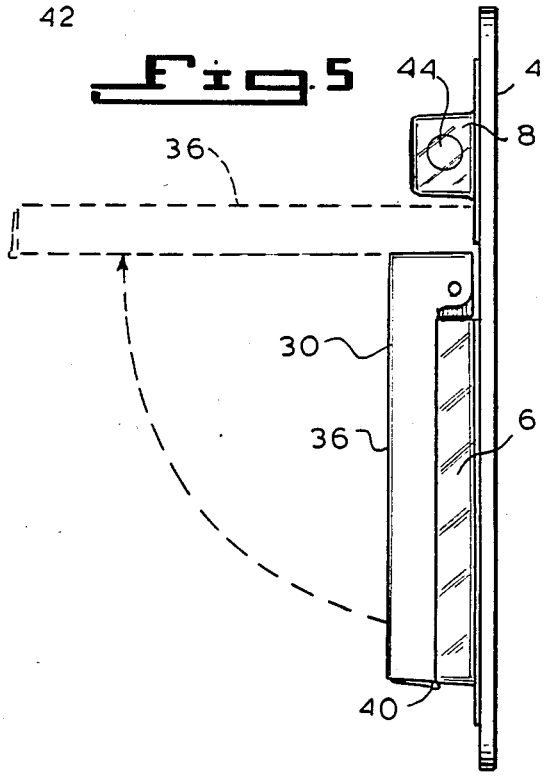
FIG. 5 is a side view of the display package and cosmetic case shown in FIG. 3, with the cover of the case in a closed position.

In its preferred form, the display package 2 of the present invention has its second blister 8 spaced from the open side 18 of the first blister 6 so that it does not interfere with the operation of the case hinge 38, or engage a portion of the cover 36 to prevent the case from opening. As shown in FIGS. 4 and 6 and in phantom in FIG. 5, the cover 36 of the case can be opened to be at least perpendicular to the base 32 to fully expose the cosmetic contents 34 of the base without the second blister 8 interfering with the movement of the cover 36. The spacing between the first and second blisters 6, 8 differs, of course, with the hinge structure of the cosmetic case 30; nevertheless, the spacing between blisters should not be so great as to prevent the second blister 8 from acting as an obstruction to the removal of the cosmetic case 30 from the first blister 6.

Figure 3:
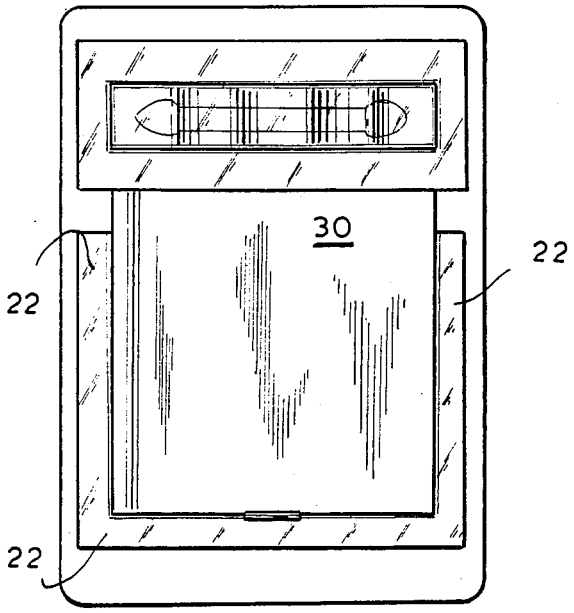
FIG. 3 is a front view of the display package of FIG. 1, with a cosmetic case secured in the package and with its cover closed.

As also mentioned previously, the second blister 8 may define an enclosure 28 for a second cosmetic article 44, as illustrated by FIGS. 3 and 4. Oftentimes, two separate articles need to be packaged together. For example, in the case of an eye shadow cosmetic product, an applicator is usually supplied with the eye shadow case. Such an applicator may be suitably housed by the second blister 8.

The first and second pre-formed blisters 6, 8 may be formed from a variety of materials, such as a vinyl resin or other thermoplastic material. A five gauge vinyl resin blister material is conventionally used, which has a thickness of between about 3 and 4 mils. Of course, the blister material may be heavier, on the order of 5–7 mils or more in thickness.

The first pre-formed blister 6, or at least the main blister portion 12 of the first blister, is preferably transparent so that the cosmetic product 34 can be viewed by the purchaser through the blister prior to her purchasing the cosmetic article. The second blister 8 may likewise be transparent. The first and second pre-formed blisters 6, 8 may be separate components and individually mounted on the support backing 4, or may be integrally formed together, as shown by FIG. 7, and together mounted on the support backing.

The display package 2 and cosmetic case 30 are preferably assembled together. The base 32 of the cosmetic case, while the case is opened, is fitted into the pre-shaped pocket 20 of the first blister 6 that at least partially conforms to the base's shape, with the cosmetic case 30 being oriented with its hinge 38 situated on the open side 18 of the blister 6. The case 30 is then closed such that the main blister portion 12, and in particular its top wall 14, is interposed between the base 32 and cover 36 of the cosmetic case and secured in place relative to the case so that the blister 6 will not shift.

The blister 6 and case 30 are then mounted on the display surface 10 of the support backing 4, with the edge flange 22 of the blister being heat sealed or adhesively joined to the backing.

The second pre-formed blister 8, with the other cosmetic article 44 contained in it (if such is to be included in the package) is then mounted on the display surface 10 of the support backing by heat sealing or adhesively joining its edge flange 29 to the backing. The second blister 8 is particularly positioned adjacent to the open side 18 of the first blister 6 and spaced from it a given distance so that it will act as an obstruction to the removal of the case 30 from the blister 6 from the open side 18 of the blister and so that it will not interfere with the case's being opened and closed. The proper spacing and position of the two blisters 6, 8 can, of course, be carried out using a properly prepared jig.

The display package of the present invention is thus a tamper resistent package for a cosmetic article, and in particular a cosmetic case, which lets the purchaser open the case to examine its contents without having to remove the case from the package. The contents of the cosmetic article may be viewed through the blister so that the purchaser can determine, prior to purchasing the article, whether the cosmetic product is suitable for her use. The use of the two pre-formed blisters, particularly shaped and positioned with respect to each other, is a simple yet effective way of packaging the cosmetic case and allowing the case to be opened and closed without removing the case from the package.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A display package for a cosmetic article, which comprises:

a support backing having a display surface;

a first pre-formed blister mounted on the display surface of the support backing, the first pre-formed blister having a main blister portion which is raised from the display surface, and an edge flange joined to the main blister portion and secured to the display surface, the main blister portion having an open side and defining a pocket for receiving a cosmetic article therein and for securing the article to the support backing; and a second pre-formed blister mounted on the display surface of the support backing, the second pre-formed blister having a main blister portion which is raised from the display surface and an edge flange joined to the main blister portion of the second blister and secured to the display surface, the second pre-formed blister being situated on the display surface adjacent to the open side of the first pre-formed blister such that the second pre-formed blister forms an obstruction to the removal of the cosmetic article from the first pre-formed blister through the open side thereof.

2. A display package as defined by claim 1, wherein the main blister portion of the first pre-formed blister is transparent.

3. A display package as defined by claim 1, wherein the support backing is formed from a substantially stiff material to resist bending thereof.

4. A display package as defined by claim 1, wherein the second pre-formed blister defines an enclosure for receiving a second cosmetic article and for securing the second article to the support backing.

5. A display package as defined by claim 1, wherein the height of the second pre-formed blister above the display surface of the support backing is at least about equal to the height of the first pre-formed blister above the display surface.

6. A display package as defined by claim 1, wherein the first and second pre-formed blister are integrally formed from a single sheet blister material.

7. A display package as defined by claim 1, wherein the material for forming at least the first pre-formed blister is a transparent thermoplastic material.

8. A display package as defined by claim 1, wherein the first pre-formed blister at least partially conforms to the shape of the cosmetic article held thereby.

9. A display package as defined by claim 1, wherein the edge flanges of the first and second pre-formed blisters are heat-sealed to the support backing to secure the first and second blisters to the backing.

10. A display package for an openable cosmetic case having a base containing a cosmetic product and a cover pivotally joined to the base, which comprises:

a support backing having a display surface;

a first pre-formed blister mounted on the display surface of the support backing, the first pre-formed blister having a main blister portion which is raised from the display surface, and an edge flange joined to the main blister portion and secured to the display surface, the main blister portion having an open side and defining a pocket for receiving the base of the cosmetic case therein and for securing the cosmetic case to the support backing; and a second pre-formed blister mounted on the display surface of the support backing, the second pre-formed blister having a main blister portion which is raised from the display surface and an edge flange joined to the main blister portion of the second blister and secured to the display surface, the second pre-formed blister being situated on the display surface adjacent to the open side of the first pre-formed blister such that the second pre-formed blister forms an obstruction to the removal of the cosmetic case from the first pre-formed blister through the open side thereof, the second pre-formed blister being spaced from the open side of the first blister a sufficient distance to allow the cover of the case to pivot with respect to the base so that the cosmetic case can be opened for viewing the contents thereof while retaining the case within the pocket.

11. In combination:

a cosmetic case, the case having a base containing a cosmetic product and a cover pivotally joined to the base, the cosmetic case being adapted to be opened and closed by pivotal movement of the cover with respect to the base for viewing the cosmetic contents thereof; and a display package for mounting the cosmetic case thereto, which package permits the opening of the cosmetic case for viewing the cosmetic contents thereof while securing the cosmetic case to the package, the display package including a support backing having a display surface, and first and second pre-formed blisters mounted on the display surface of the support backing, each of the first and second pre-formed blisters having a main blister portion raised from the display surface of the support backing and an edge flange joined to its respective main blister portion and secured to the display surface, the main blister portion of the first pre-formed blister having an open side and defining a pocket for receiving the base of the cosmetic case therein and for securing the cosmetic case to the support backing, the main blister portion of the first pre-formed blister being transparent and being interposed between the cover and the base of the cosmetic case when the case is closed and covering a substantial portion of the cosmetic contents of the case to protect the cosmetic contents while allowing the cosmetic contents to be viewed through the main blister portion of the first blister when the case is open, the second pre-formed blister being situated on the display surface adjacent to the open side of the first pre-formed blister such that the second pre-formed blister forms an obstruction to the removal of the cosmetic case from the first pre-formed blister through the open side thereof, the second pre-formed blister being spaced from the open side of the first blister a sufficient distance to provide space for the cover to pivot with respect to the base without interference from the second pre-formed blister so that the cosmetic case can be opened for viewing the contents thereof while retaining the case within the pocket.

12. A method of assembling a display package together with a cosmetic case of the type having a base containing a cosmetic product, a cover pivotally joined to the base, and a hinge joining the base and cover together, wherein the cosmetic case is adapted to be opened and closed by pivotal movement of the cover with respect to the base for viewing cosmetic contents thereof, the method comprising the steps of:

positioning the base of the cosmetic case, while open, in a first pre-formed blister, the first pre-formed blister having a main blister portion shaped to at least partially conform to the shape of the base of the cosmetic case and at least partially defining a pocket for receiving the base therein, the main blister portion defining the pocket with an open side, and the cosmetic base being oriented with respect to the first pre-formed blister such that the hinge thereof is situated on the open side of the blister;

closing the cosmetic case about the main blister portion of the first pre-formed blister such that the main blister portion is interposed between the base and cover of the case and secured in place relative to the case;

mounting the first pre-formed blister and cosmetic case, while closed, on a support backing, the first pre-formed blister having an edge flange joined to the main blister portion thereof for securing the first blister to the support backing; and mounting a second pre-formed blister on the support backing, the second pre-formed blister having a main blister portion and an edge flange joined to the main blister portion for securing the second blister to the support backing, and positioning the second pre-formed blister adjacent to the open side of the first pre-formed blister such that the second pre-formed blister forms an obstruction to the removal of the cosmetic case from the first pre-formed blister through the open side thereof.

* * * * *